United States Patent [19]

Csenky

[11] 4,074,092

[45] Feb. 14, 1978

[54] SAFETY POWER TRACK SYSTEM

[75] Inventor: László Csenky, Budapest, Hungary

[73] Assignee: Szarvasi Vas-Femipari Szovetkezet, Szarvas, Hungary

[21] Appl. No.: 648,364

[22] Filed: Jan. 12, 1976

[30] Foreign Application Priority Data

July 16, 1975 Hungary ..... 2818

[51] Int. Cl.[2] ..... H01R 19/50; H01R 19/52

[52] U.S. Cl. ..... 200/51.07; 339/21 R; 339/22 B

[58] Field of Search ..... 200/51.07, 51.08, 50 B; 339/21 R, 22 R, 22 B, 14 R

[56] References Cited

U.S. PATENT DOCUMENTS

| | | | |
|---|---|---|---|
| 3,569,899 | 3/1971 | Laser | 339/21 R |
| 3,718,816 | 2/1973 | Seelbach et al. | 339/22 B |
| 3,792,413 | 2/1974 | Hyrlainen | 339/21 R |
| 3,848,715 | 11/1974 | Hesse | 339/21 R |
| 3,951,488 | 4/1976 | Hesse et al. | 339/14 R |

*Primary Examiner*—David Smith, Jr.
*Attorney, Agent, or Firm*—Ernest F. Marmorek

[57] ABSTRACT

A safety power track system for carrying light fixtures including a light source includes a generally U-shaped supporting rail, the limbs of which have inwardly bent ends. An internal insulating lining fits into the rail, and has at least a first current conductor embedded therein; a grounding member is connected to the ends of the limbs of the rail, and at least a second current conductor is mounted in, or on an externally inaccessible portion of the lining that faces inwardly of the rail. A transversely mounted, reciprocally movable push-button switch has "on" and "off" positions and is formed with an oblique groove; a presser cam is guided for movement in the groove, and at last two conductors engage the cam in the "on" position. Conductor springs are provided for making contact with the cam, and a conductor fixing screw establishes contact of the spring and the cam. A third conductor is disposed in the interior of the adaptor and connected to one of the contactors, each of the contactors being a generally C-shaped body. The contactors are arranged back-to-back, and an insulating plate surrounds, as well as mutually separates the contactors.

4 Claims, 1 Drawing Figure

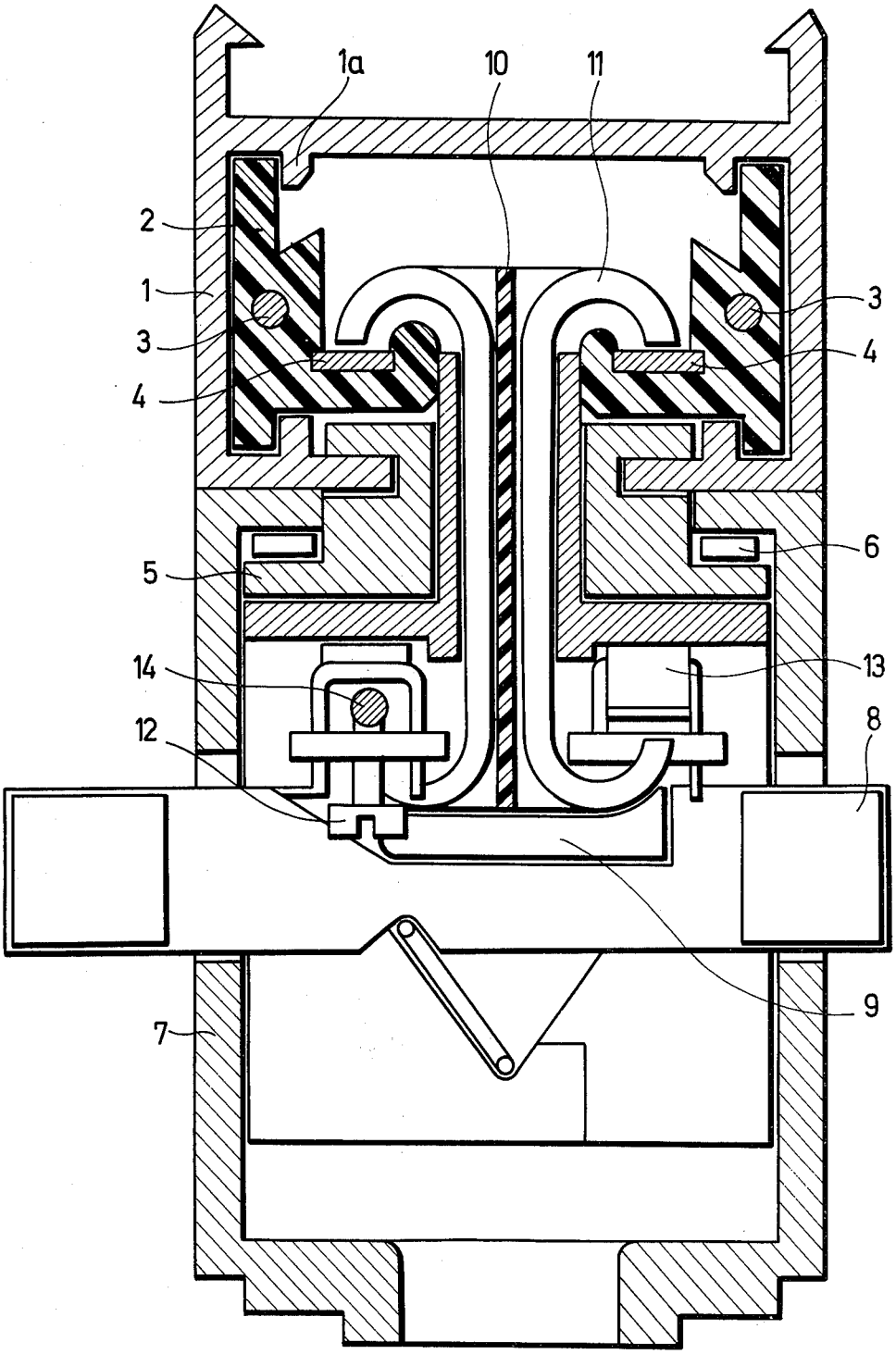
1a
10
11
2
1
3
3
4
4
5
6
14
13
12
8
9
7

SAFETY POWER TRACK SYSTEM

BACKGROUND OF THE INVENTION

The invention concerns a touch-safe power track connection system.

Current methods of illuminating technology extensively exploit varied lighting effects, and users are no longer satisfied with centrally placed ceiling-mounted lighting fixtures or wall-mounted fixtures carried on arms.

This is particularly the case for lighting workshops, laboratories, shop-windows, studios, exhibition stands and similar rooms where special attention is paid to achieve concentrated lighting effects such that at the time an adequate level of illumination is ensured for the rest of the room. It is also often required that the light distribution between individual, highlighted room portions should be differentiated, i.e. illuminated articles-/objects should receive light of differing intensity and from differing directions without causing any disturbing effects by concentrated or scattered light.

To this end power track connection systems have been employed.

The use of power track systems for such purposes is in itself known. Thus, a West German company, Leuchten KG, markets such a system under the trade name ERCO. This 3-phase connection power track system consists essentially of an open rectangular-section aluminium rail having an inner lining made of PVC of similarly sectional shape. The R,S,T phase conductors and the neutral conductor, made of copper, are embedded in the PVC. The earth conductor runs along the length of the lower, open end aluminium rail. The space for the cables, the so-called cableage is accommodated at two sides of a connecting or mounting yoke which is to be fixed to the ceiling and which is formed at the upper part of the rail section.

The manufacture of aluminum rails is well known and essentially consists of a continuous extrusion operation. For aesthetic reasons the rails are colored, preferably by electrolytic oxidation. The earth conductor is rolled into the rail during the manufacture of the latter. The phase-cables take the form of strips. In one of the lower legs of the rail section there is a guiding groove into which the tongue of a phase switch of the adaptor fits.

Lighting fixtures can be fitted into the power track by means of a tailor-made adaptor which has a casing made of plastics with a 3-way press button switch. In one of the possible switching positions the adaptor can be fitted into the power track, during which time the earth cable loop provides the necessary protective earthing. In the zero or neutral position the adaptor and the power track are mechanically locked. In the third switching position connection is established between the copper strip conductors and the four contacts of the track. In addition, the adaptor may be fitted with a selector switch which serves for the selection of the circuit required before the adaptor is fitted.

If any of the embedded conductors is to be switched to some other power track this can only be done if the circuit of this latter is not overloaded thereby.

The power track described above has, besides its advantages (quick and easy installation, easy handling, relatively light weight, etc.) a decisive drawback.

For safety reasons, the R, S, T phase cables and neutral cable must have a gap of 8 mm between the opposite profiles of the aluminium track, but any current-conducting object slimmer than 8 mm can be inserted into the gap remaining in this way, along the whole length of the track. This represents a high accident risk, particularly if it is considered that the tracks generally do not run completely in a straight line but are angled at a given position. In case of repairs during usage, installation, etc. such an open conductor system represents a real danger for causing an accident even for skilled electricians.

SUMMARY OF THE INVENTION

The invention seeks to eliminate these shortcomings of existing power track systems by a design which, whilst retaining all the advantages of the known power track systems, makes it practically impossible for the switched-on conductors to be touched either by chance or during use.

The power track system provided by the invention consists essentially of a U-shaped aluminium rail lined internally on both limbs with a hard insulating plastics material in which the conductor cables and two further cables are so embedded that they are concealed. The inwardly bent limbs of the U-shaped rail are surrounded on both sides along their lengths by an aluminum body also running along the length, of the U-shaped rail, the aluminum body having oblong ends facing both sides of the track below which there are leaf springs mounted to ensure the mechanical locking of the adaptor after it has been fitted into the track and at the same time performing the earthing. The fitting of a lighting fixture into the aluminum track provided with conductors is carried out by using an adaptor suitable for the construction embodied in the invention.

This adaptor is preferably a parallelepipedal member having a push-button switch mutually insulated copper contactors having bent ends embedded in the member. The contactors, the latter can be connected with the conductors by means of presser-actuated springs.

The construction offered by the invention has the substantial advantage that the adaptor placed in the open gap of the track can be fixed in position by a single turn of 90°.

BRIEF DESCRIPTION OF THE DRAWING

A preferred embodiment of the invention is described, merely by way of example, with reference to the accompanying drawing, in which the sole FIGURE of the drawing is a sectional view of the power track with an adaptor fitted therein.

DESCRIPTION OF THE PREFERRED EMBODIMENTS

In the drawing, a current-conveying support rail 1 is made of an U-shaped section. Each of the two limbs of the U-shaped section is bent inwardly as its lower end and has at the top and at the bottom a respective fixing rail 1*a* facing towards the inside of the U-shaped rail and running along its full length. In section each fixing rail 1*a* appears as a projecting lug. The limbs of the U-shaped support rail are extended at the top and serve for mounting the support rail 1 to a given mounting plate or surface. The fixing rails 1*a* on the rail 1 support a profiled plastics insulator body 2 in which a cable 3 is embedded, the current-conveying rails 4 being embedded in a part of the body 2 projecting inwardly of the U-shaped section. On the lower part of the U-shaped support rail there are two aluminum earthing pieces 5 which surround the bent lower ends of the limbs of the rail 1, are made of aluminum and extend along the full length of the U-shaped rail 1. A respective leaf spring 6 is disposed in a gap between an extension of each earthing piece 5 facing the inwardly bent lower limb ends of the rail 1, and a flange of the plastics sidewall of the adaptor secured to the U-shaped rail 1. The adaptor which carries the lighting fixture and which can easily be formed also as a switch, is thus fitted into the groove formed between the plastics insulator body 2, aluminum the aluminium earthing or grounding pieces 5, and the inwardly projecting limbs of the rail.

The adaptor is housed in a parallelepipedal plastics casing 7 and comprises a transversely mounted push-button switch 8 pressable against a spring force into "on" or "off" positions. Two contactors 11, each bent at both ends, are separated by an insulator plate 10 and abut a presser cam 9 disposed in a cavity in the push-button switch 8. The upper bent ends of the contactors 11 in the "on" position are in contact with the current-conveying rail 4. Their bottom, bent ends are caused to abut conducting springs 13 by respective metallic fixing screws 12. One of the contactors is at the same time connected to a conductor 14 inside the adaptor. The bottom of the adaptor is shaped suitably to receive the socket of a lighting fixture, or alternatively is covered by a protecting cover plate.

The touch-safe power track system according to the invention operates as follows:

In the switched-off position the adaptor is placed perpendicularly into the rail so that the contactors 11 project into the groove of the rail 1. The adaptor is subsequently twisted with gentle pressure to the right or left by 90°. A slight click indicates the homing of the adaptor.

The support rail 1, which is initially at earth potential, ensures the protection of the adaptor by means of the earthing or grounding body 5. Then by pressing the push-button switch 8, the pressure cam 9 (made perferable of plastics material) releases the contactors 11 from the force of the springs 13 and thus the contactors 11 are pressed against the current-conveying rails 4.

Switching "off" is the reverse of this procedure, i.e. by pressing the push-button switch 8 on the opposite side of the adaptor, by virtue of the oblique path of the switch, pressure is exerted on the cam 9 which releases contactors 11 from the current-conveying rails 4.

This particular design offers an added safety advantage. The normal commercial household wall switches break circuits by cutting out one conductor only, so that there is a danger of an accident occurring due to a faulty or incorrect installation of the switch The design embodiment in the invention makes it possible for both current-conveying rails to be disconnected, thus wholly eliminating the danger of such an accident.

The removal of the adaptor is very readily carried out by slightly pulling out the casing in the "off" position, and twisting it by 90°. In other words, the adaptor can be removed from the current-conducting rails only after the system has been switched off.

The cable 3 has an important function which makes it possible to connect directly the power track system according to the invention, which may be constructed on a modular basis, to any household circuit network without using conventional installation methods. Namely, if the support rail 1 with its cable 3 is connected to a source of potential by a T-junction, then the rails 4 may also be connected to the source of the potential, and by switching off the push-button switch on the adaptor the lighting network of a household can be switched off as required, for example in order to switch off all plug-in sockets of a household.

The conductor 14 has two functions, namely it ensures a connection for the consumer by connecting the switched-on current rails 4 and also, when the contactors 11, and the adaptor is used as switch gear it it possible to connect the cable 3 to the position of the conductor 14 in which case current is passed in the switched-on state of the contactors 11 to the current rails 4.

What I claim is:

1. A safety power track system for carrying light fixtures, including a light source, comprising a generally U-shaped supporting rail, the limbs of which have inwardly bent ends, an internal insulating lining fitted in the rail and having at least a first current conductor embedded therein, earthing means connected to the bent ends of the limbs of the rail, and at least a second current conductor mounted in or on an externally substantially inaccessible portion of the lining that faces inwardly of the rail, a transversely mounted, reciprocally movable push-button switch having "on" and "off" positions and being formed with an oblique groove, a presser cam being guided for movement in said groove, at least two contactors engaged by the cam in the "on" position, conductor springs for making contact with said cam, a conductive fixing screw for establishing contact of said springs and said cam, and a third conductor disposed in the interior of the adaptor and connected to one of the contactors, wherein each of said contactors is a generally C-shaped body, the contactors being arranged back-to-back, and insulating means for surrounding, as well as mutually separating said contactors.

2. A safety power track system for carrying light fixtures, including a light source, comprising a generally U-shaped supporting rail the limbs of which have inwardly bent ends, and internal insulating lining fitted in the rail and having at least a first current conductor embedded therein, earthing means connected to the bent ends of the limbs of the rail, and at least a second current conductor mounted in or on an externally substantially inaccessible portion of the lining that faces inwardly of the rail, a transversely mounted push-button switch having "on" and "off" positions, being formed with an oblique groove, and being movable in a first direction, a presser cam being guided for movement in said groove, cam follower means including at least two contactors engaged by the cam in the "on" position, conductor springs for making contact with said cam, a conductive fixing screw for establishing contact of said spring and said cam, and a third conductor disposed in the interior of the adaptor and connected to one of the contactors, said cam follower means being movable by said switch in a second direction differing from said first direction.

3. A safety power track system according to claim 1, wherein said first current conductor is substantially inaccessible.

4. A safety power track system according to claim 2, wherein said first current conductor is substantially inaccessible.

* * * * *